US005768803A

United States Patent [19]

Levy

[11] Patent Number: 5,768,803

[45] Date of Patent: Jun. 23, 1998

[54] ADJUSTABLE INSOLE FOR SUPPORT OF PAINFUL FOOT AREAS

[76] Inventor: Dodd M. Levy, 902 Seton Dr., Cumberland, Md. 21502

[21] Appl. No.: 647,678

[22] Filed: May 15, 1996

[51] Int. Cl.[6] ..... A43B 13/38

[52] U.S. Cl. ..... 36/43; 36/140

[58] Field of Search ..... 36/43, 44, 140

[56] References Cited

U.S. PATENT DOCUMENTS

| | | |
|---|---|---|
| 1,549,237 | 8/1925 | Vaughan . |
| 2,135,725 | 11/1938 | Merritt . |
| 2,675,633 | 4/1954 | Gaynor . |
| 2,909,854 | 10/1959 | Edelstein . |
| 4,557,060 | 12/1985 | Kawashima . |
| 4,633,877 | 1/1987 | Pendergast . |
| 4,793,078 | 12/1988 | Andrews . |
| 4,800,657 | 1/1989 | Brown . |
| 4,813,157 | 3/1989 | Boisvert . |
| 4,841,648 | 6/1989 | Shaffer . |
| 4,905,383 | 3/1990 | Beckett . |
| 5,005,575 | 4/1991 | Geri . |
| 5,150,490 | 9/1992 | Busch . |
| 5,329,705 | 7/1994 | Grim . |
| 5,438,768 | 8/1995 | Bauerfeind . |

*Primary Examiner*—Ted Kavanaugh

*Attorney, Agent, or Firm*—Cushman Darby & Cushman Intellectual Property Group of Pillsbury Madison & Sutro, LLP

[57] ABSTRACT

In a first embodiment of the invention, an adjustable support insole system is provided for use in a shoe. The system includes a bottom inside layer including a plurality of segments removably attached to a bottom surface of an insole layer, e.g. the top layer. At least one of the sections may be removed to create an empty space directly beneath a corresponding painful area of a foot. Suitable means are provided for removably attaching the removable sections. In a second embodiment of the invention, a first foot-shaped layer is provided together with a second foot shaped layer spaced from the first foot-shaped layer such that a sleeve type arrangement is formed between said first and second foot-shaped layers. An insert having a plurality of fluid filled sacs is provided for insertion into the sleeve arrangement. The individual sacs can be deflated such that the deflated sac is positioned directly beneath a corresponding painful area on the foot and the remaining fluid filled sacs provide support to the surrounding foot areas.

15 Claims, 5 Drawing Sheets

ADJUSTABLE INSOLE FOR SUPPORT OF PAINFUL FOOT AREAS

BACKGROUND OF THE INVENTION

The present invention relates to the area of podiatric medicine. More particularly, this invention relates to the treatment of painful foot prominances such as corns, callouses, metatarsal conditions, or other painful areas of the foot.

Many people suffer from painful foot conditions. Most of these conditions, such as corns and callouses, have over-the-counter treatments available that serve as an inexpensive alternative to a visit to the doctor or physician.

For others who experience pain from foot conditions, such as metatarsal prominances, the only treatment available is to have orthotics specially fabricated to relieve pressure on the painful area while supporting the surrounding areas. These orthotics are expensive to produce and are often not covered under medical insurance. Additionally, the orthotics take some time to produce, while the patient continues to suffer in the meantime.

Therefore, there is a need for a device which can be sold over-the-counter to persons who suffer from painful foot conditions, such as metatarsal prominances. There is also a need for a product which can relieve pressure on the painful area while supporting the surrounding area.

Originally, insoles were devised having a preformed aperture positioned beneath the afflicted area with a fabric covering over the aperture. However, such insoles did not provide for any adjustability in the size, shape or location of the aperture.

Several insoles have been designed with areas of varying strength and support. Many of these insoles have been designed to help athletes in their performance. Other insoles have been designed for treatment and relief of foot conditions.

For example, U.S. Pat. No. 4,793,078, issued to Andrews, shows an insole that has several preformed depressions in the top portion of the insole. These depressions are filled with inserts. The patient can remove the particular insert which generally corresponds to the painful area on their foot. The removal of the insert produces a void beneath the painful area thereby relieving pressure ont it. The insole is formed having more than one removable insert, thereby making it an insole which can be adapted to their particular foot condition. However, as the inserts and the corresponding depressions are preformed, there is no adjustability with regard to the size, shape or positioning of the insert to be removed.

Another such device is shown in U.S. Pat. No. 5,438,768, issued to Bauerfeind. In this insole, the depressions are positioned on the bottom of the insole. Glue and a velcro flap are used to secure the inserts in place. Again, as in the Andrews device, there is no adjustability with regard to the size, shape or positioning of the inserts or depressions.

In order for the insole to function properly in relieving pressure on the painful area and supporting the surrounding area, there must be some degree of adjustability in size, shape and location of the removable insert. Adjustability is needed to account for variability in the width, length and position of the particular sensitive area. While the prior art insoles contain some degree of adjustability, the amount of adaptation is limited by the size, shape and location of the depressions. Therefore, the use of these insoles as an over-the-counter solution for such foot problems as metatarsal prominences would not provide the required amount of adjustability needed to cover a wide area of the foot.

Additionally, the insole must be made such that it is easy for the user to identify which particular insert is to be removed, and the identification and removal of the proper insert for the prior art insoles could prove difficult for some persons.

Therefore, there is a need for an adjustable insole which can be finely tuned to needs of a particular individual. Moreover, there is a need for an insole wherein the user can easily identify and remove the proper insert.

SUMMARY OF THE INVENTION

The present invention is directed to an insole that satisfies these needs. The features of the present invention are incorporated in an insole having a top foot-shaped insole layer, a bottom layer which is removably attached to a bottom surface of the top foot-shaped insole layer, and means for removably attaching the bottom layer to the top foot-shaped layer. The bottom layer is formed of a plurality of removable sections extending downwardly and substantially transversely therethrough. One or more of the sections may be removed to create an empty space directly beneath a corresponding painful area on a foot. The remaining sections provide support to the surrounding foot areas.

In an alternative embodiment of the present invention, there is provided a first foot-shaped layer, and a second foot-shaped layer attached to the first layer in such a way that a sleeve is formed between the first and second foot-shaped layers. There is also provided an insert for insertion between the first and second layer having a plurality of air filled sacs. The individual air sacs can be deflated such that the deflated air sac is positioned directly beneath a corresponding painful area on the foot and the remaining filled air sacs provide support to the surrounding foot areas.

BRIEF DESCRIPTION OF THE DRAWINGS

These and other features, aspects and advantages of the present invention will become better understood with regard to the following description, appended claims, and accompanying drawings wherein:

DETAILED DESCRIPTION OF THE DRAWINGS

Figure 1A:
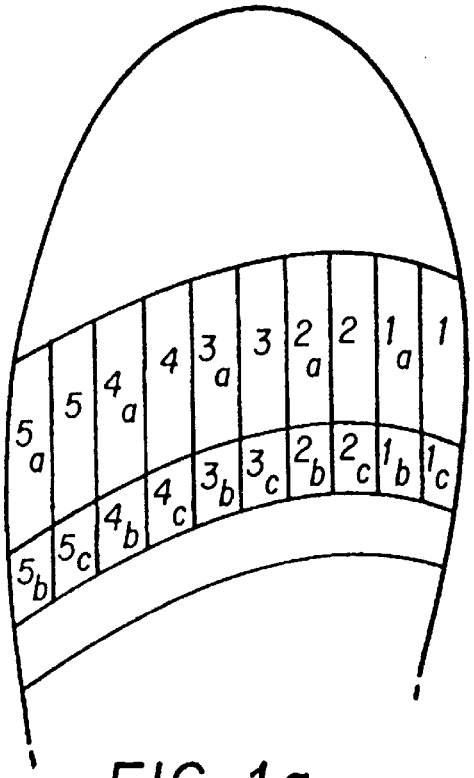
FIG. 1*a* is a broken away bottom plan view of an embodiment of the invention.
Figure 1:
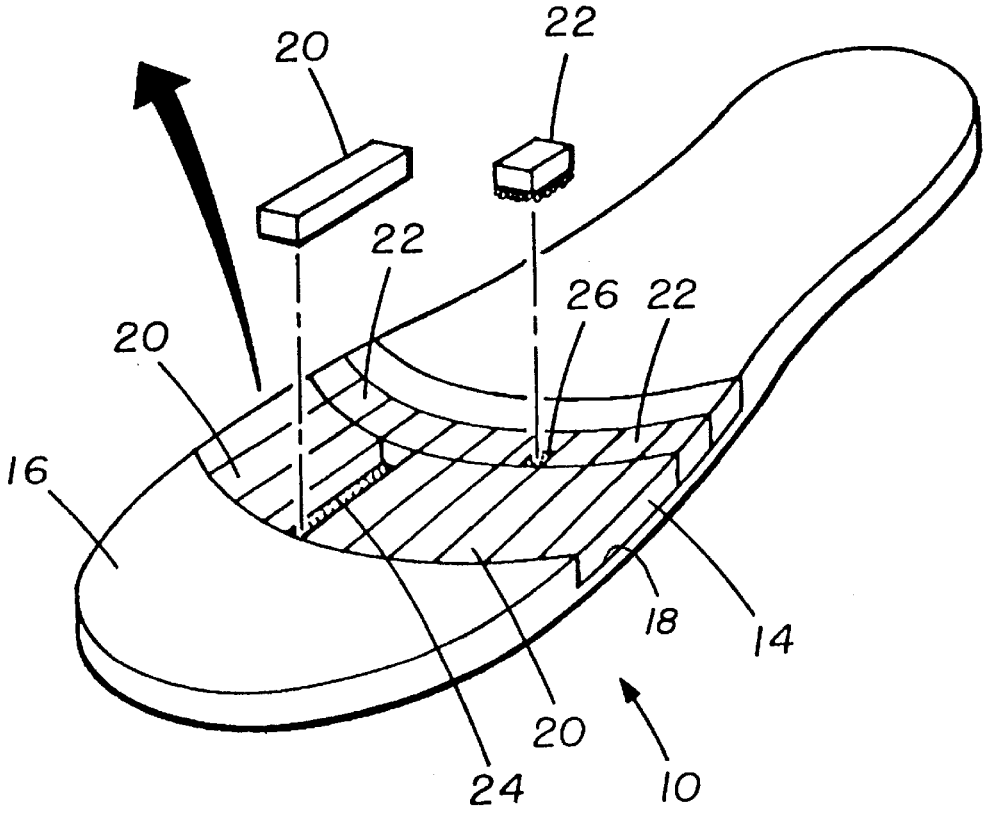
FIG. 1 is bottom perspective view of one embodiment of the present invention.
Figure 4:
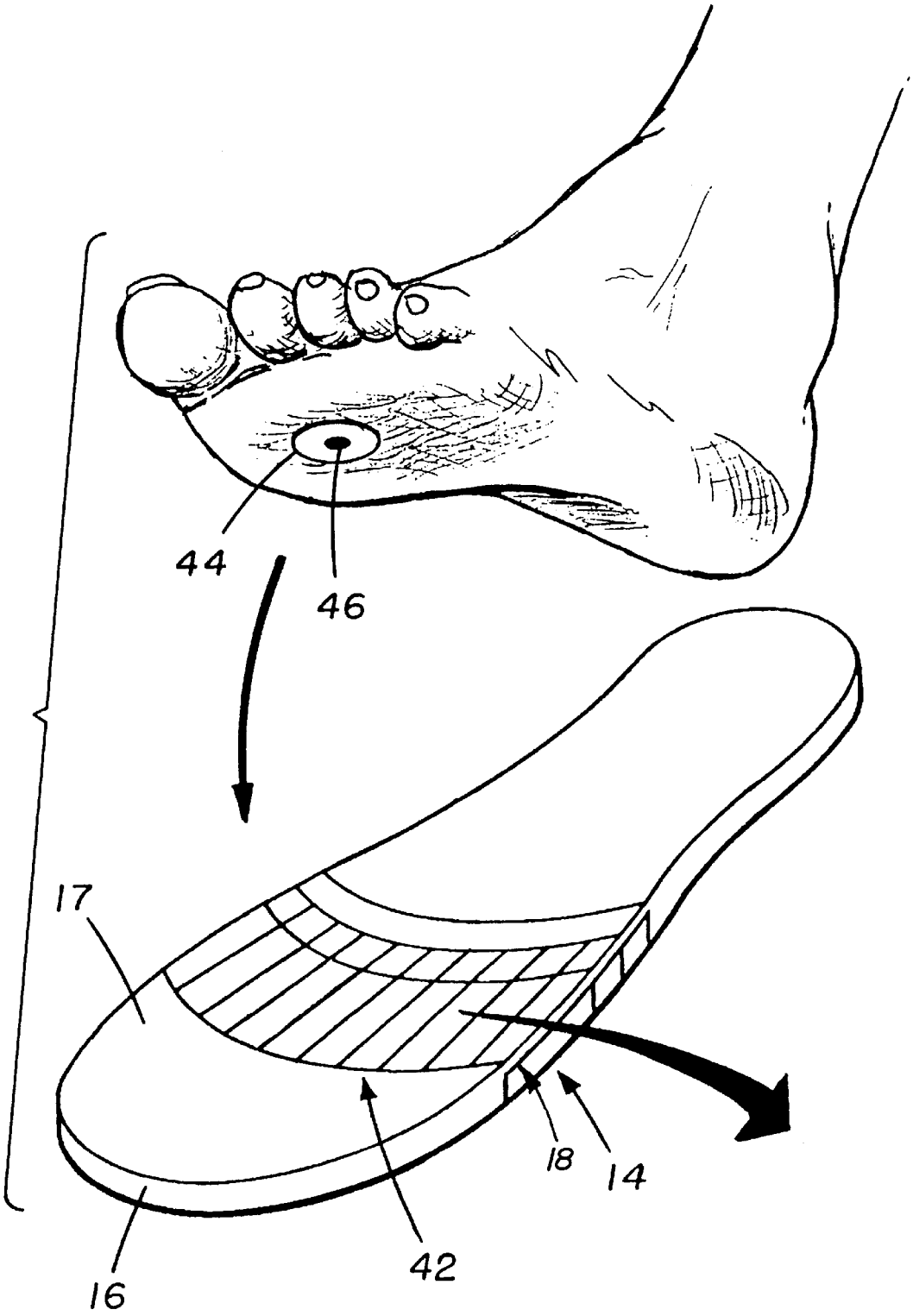
FIG. 4 is a top perspective view of the embodiment of FIG. 1 illustrating the identification of the section corresponding to the painful foot area.
Figure 4A:
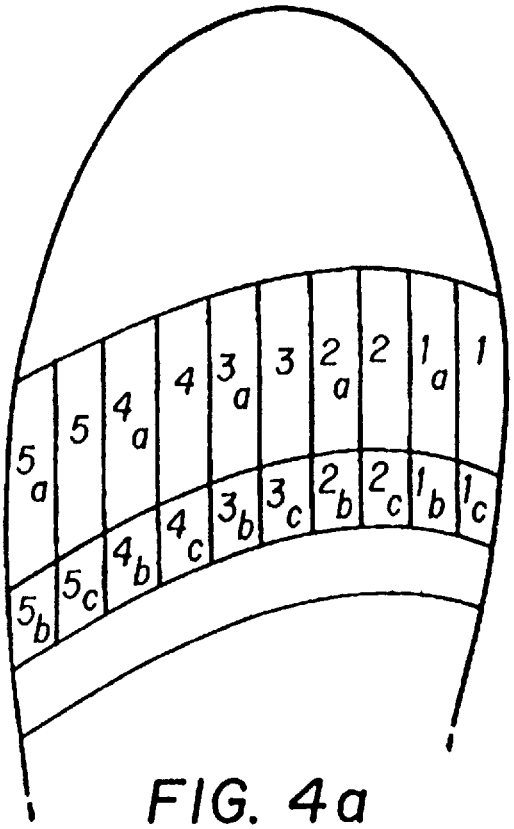
FIG 4*a* is a broken away top plan view of the insole shown in FIG. 4.

Referring now to FIGS. 1 and 4 of the drawings, there is shown an adjustable support insole system 10 for a foot to be inserted into a shoe (not shown). This system 10 consists of a bottom layer 14 and a top insole layer 16. The bottom layer 14 is removably attached to the bottom surface 18 of the top insole layer 16.

This bottom layer 14 is formed of a plurality of removable sections 20 and 22 which extend downwardly and substantially transversely therethrough so that at least one or more sections 20 and\or 22 may be removed to create an empty space 24 and 26, respectively, directly below a corresponding painful area of the foot 12. The layers 14 and 16 can be removably attached by a hook and loop material or an adhesive material.

The removable sections 20 and 22 are of two different lengths. The dividing line between the longer section 20 and the shorter section 22 corresponds to the anatomical average metatarsal head length of the prospective users. The shorter section 22 allows for variation for those persons having shorter metatarsal heads. Additionally, widthwise there are two sections, labeled in FIGS. 1 and 4 as 1 and l*a*, 2 and 2*a*, 3 and 3*a*, 4 and 4*a*, and 5 and 5*a*, per metatarsal head providing for further adjustability. Moreover, additional removable sections could be added to provide for further variations proximally, distally or both.

The individual sections 20 and 22 as shown in FIG. 1 are labeled with number/letter combinations. Therefore there are four individual sections 20 and 22 for each metatarsal head as indicated by an individual number and the number followed by a, b, or c. For example, sections 1, l*a*, 1*b* and l*c* all correspond to the same metatarsal head. The user can remove as many or as few sections 20 and 22 as are necessary to relieve pressure on the painful foot area. Alternate identification methods well known in the art may be used such as color coding, numbering, lettering or any combination thereof.

Referring now to FIG. 4, a chart 42 directly corresponding to the multi-sectional bottom layer 14 is printed on the top surface 17 of the top insole layer 16. In order to identify the exact sections 20 and/or 22 which correspond to the painful foot area, a marking system is used. An adhesive patch 44 bearing oil 46, ink or any other such marking agent is placed by the user on the painful foot area. The insole 10 is placed in a shoe and then the user puts his or her foot into the shoe as well. As the patch 44 and oil 46 come into contact with the top layer of the insole 16 a mark is made indicating the section that corresponds to the painful foot area.

The user removes his or her foot and the insole 10 from the shoe. Using the chart 42 the user can identify and remove the appropriate section 20 or 22 from the bottom multi-sectional layer 14 which corresponds to the section marked on the chart 42. The insole 10 is then ready for use.

Figure 2:
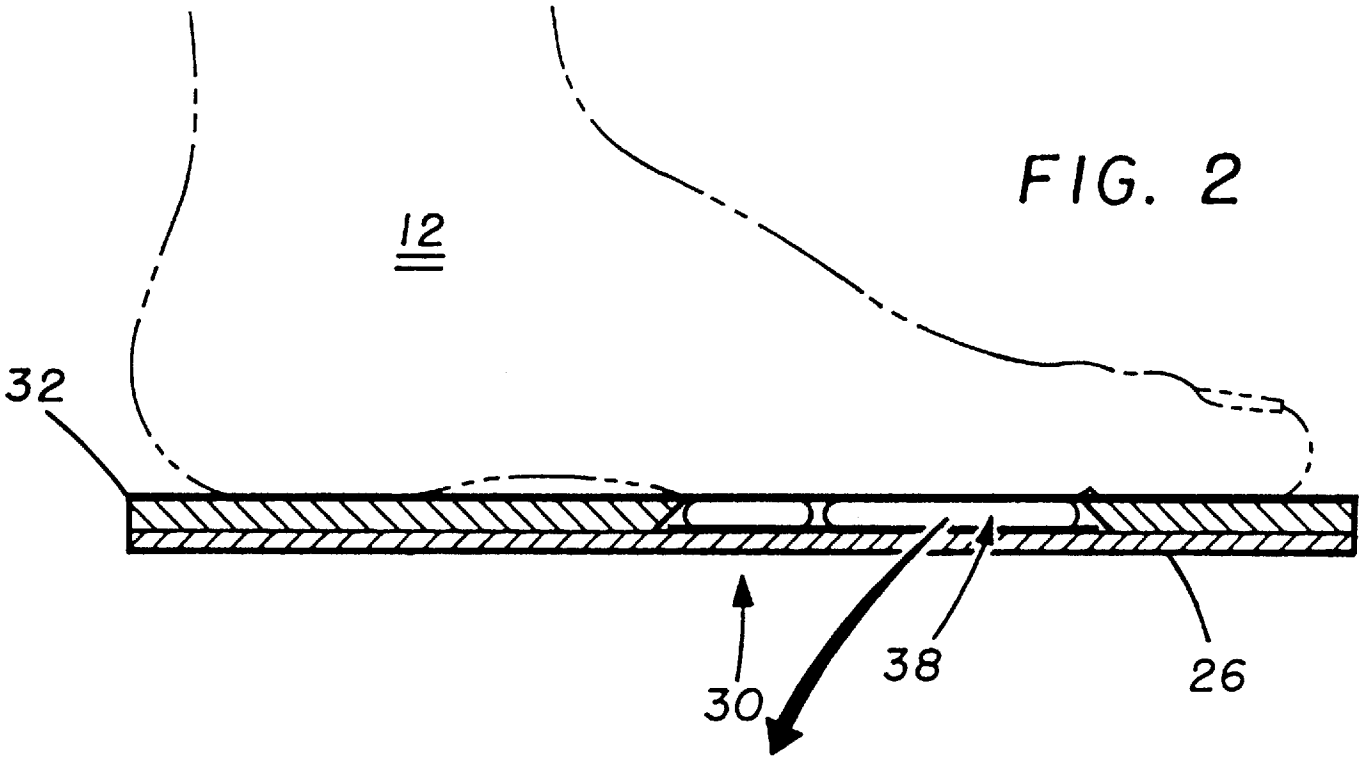
FIG. 2 is a side view of a second embodiment of the invention.
Figure 3:
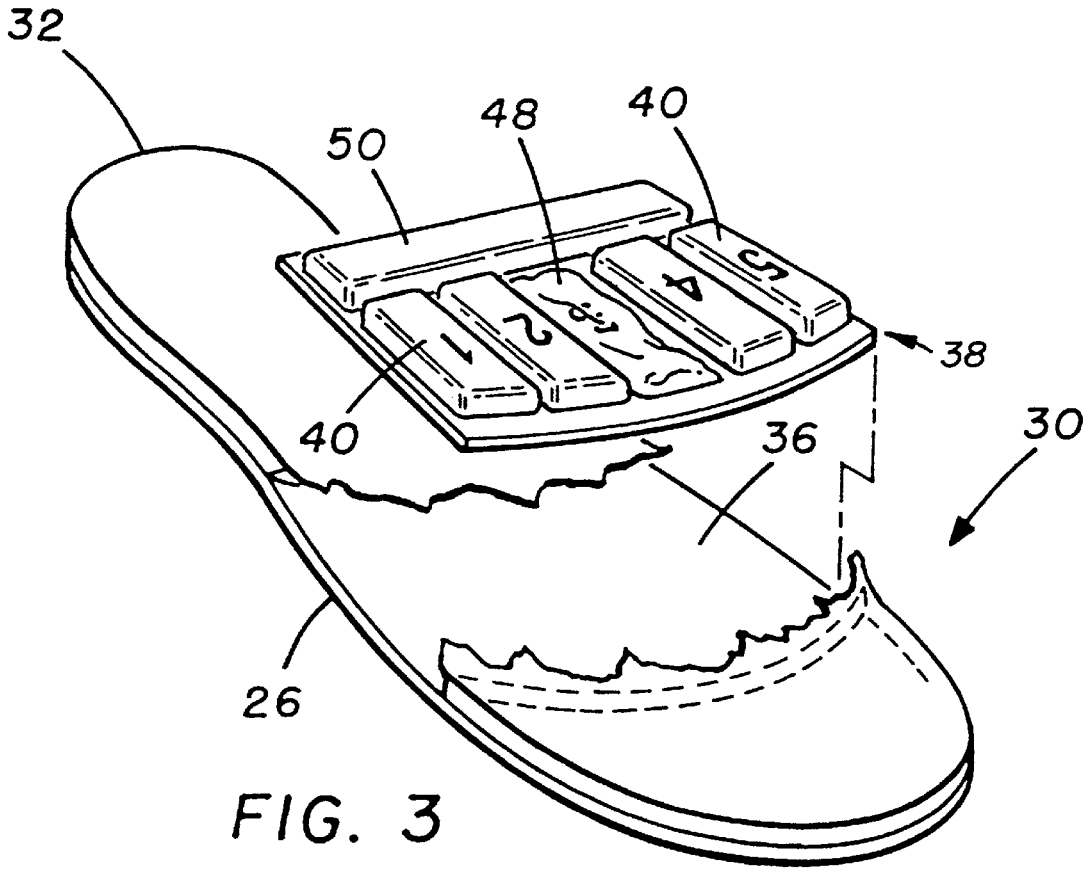
FIG. 3 is a perspective view of an air sac insert to be inserted into the embodiment of in FIG. 2.

Referring now to FIGS. 2 and 3, there is shown a second embodiment of the invention 30 which consists of an adjustable support insole system for use by a foot 12. The insole 30 has a first foot-shaped layer 32 and a second foot-shaped layer 26. The first foot-shaped layer 32 and the second foot-shaped layer 26 are attached to each other in such a way that a sleeve type arrangement 36 is formed between the first and second foot-shaped layers 32 and 26, respectively.

An insert 38 having a plurality of air filled sacs 40 can be inserted into the sleeve 36. The air sacs 40 extend substantially transversely to the first and second foot shaped layers 32 and 26 respectively. The insert 38 can correspond directly to metatarsal region of the foot, however it could extend further for other foot conditions. The air sacs 40 can be any desired shape, number or thickness. FIG. 3 shows an insert 38 having five transverse air sacs 40. An additional air sac 50 is provided for proximal support of the areas surrounding the painful foot region.

The air sacs 40 are labeled, again with numbers, letters, colors or any combination thereof for easy identification. A chart 42 and marking system similar to that described in connection with the first embodiment of this invention can again be used to identify the particular air sac 40 directly corresponding to the painful foot area. Once identified, the particular air sac 48 can be deflated and the insert placed into the sleeve. The deflated air sac 48 produces an empty space immediately beneath the painful foot area while the remaining inflated sacs 40 provide support to the surrounding areas.

Although the present invention has been described in considerable detail with respect to certain preferred versions thereof, other versions are possible. For example, the number, size and shape of the sections 20 and 22 and air sacs 40 could be varied for foot conditions other and the method of identifying the particular section to removed could be altered as well. Therefore, the spirit and scope of the appended claims should not be limited to the description of the preferred versions contained herein.

What is claimed is:

1. An adjustable support insole system for a foot for use in a shoe, comprising:

an insole layer;

a bottom layer which is attached to a bottom surface of said insole layer, said bottom layer including a plurality of removable sections, at least one of said sections being removable to create an empty space directly beneath a corresponding painful area of a foot; and means for removably attaching said removable sections to said bottom surface of said insole layer, whereby at least one of said sections can be removed to eliminate a support provided thereby and wherein the insole system has a substantially continuous top surface for contact with the foot before and after removal of at least one said section, wherein said removable sections each have first indicia including at least one of alpha numeric and color indicia for individually identifying each of said plurality of removable sections; and further comprising second indicia including at least one of alpha numeric and color indicia provided on said top surface so as to correspond to said first indicia of said purality of removable sections.

2. An adjustable support insole system for a foot for use in a shoe as recited in claim 1 wherein said removable sections directly correspond to the metatarsal region of a foot.

3. An adjustable support insole system for a foot for use in a shoe as recited in claim 1 wherein said insole layer is foot-shaped.

4. An adjustable support insole for a foot for a shoe as recited in claim 1 wherein said removable attachment means is an adhesive material.

5. An adjustable support insole for a foot for use in a shoe as recited in claim 1 wherein said attachment means is a hook and loop material.

6. An adjustable support insole system for a foot for use in a shoe as recited in claim 1 wherein said plurality of removable sections extend substantially transversely to said insole layer.

7. An adjustable support insole system for a foot for use in a shoe as claimed in claim 1, wherein said removable sections are of different sizes.

8. An adjustable support insole system for a foot for use in a shoe as claimed in claim 1, wherein there are a plurality of generally rectilinear segments disposed generally transversely of and a plurality of generally rectilinear segments disposed generally longitudinally of the insole layer, said segments being disposed in substantially side by side, parallel relation.

9. The insole system according to claim 1, in combination with a patch component having an adhesive layer for selective temporary attachment to an area of the foot and carrying a marking agent for selectively marking the upper surface of the insole system.

10. An insole system as in claim 9, further comprising further indicia including at least one alpha numeric and color indicia provided on the bottom surface of said insole member so as to correspond to said indicia on said top surface.

11. An insole for a shoe that supports a foot disposed in the shoe, the insole comprising:

a generally planer insole member having a top and a bottom surface and adapted to be inserted into the shoe, the insole member having a plurality of segments defined one of therein and thereon, each section being constructed and arranged to support a portion of a corresponding section of the foot, wherein the support provided by at least one of said segments can be selectively eliminated whereby support for a painful portion of the foot is substantially eliminated and remaining portions of the foot are supported by segments disposed adjacent said at least one segment, wherein said segments are remote from said top surface, said top surface defining a substantially smooth, continuous surface for receiving the foot, further comprising indicia including at least one of alpha numeric and color indicia provided on said top surface of said insole, said indicia individually identifying a location of each of said segment.

12. The insole according to claim 11, wherein at least some of said segments are detachably secured to a reminder of said insole member, removal of said at least one segment eliminating the support provided thereby.

13. The insole according to claim 11, wherein at least some of said segments are fluid filled compartments, substantial removal of the fluid of at least one said compartment eliminating the support provided thereby.

14. The insole according to claim 13, wherein said fluid is a gas.

15. The insole system according to claim 11, in combination with a patch component having an adhesive layer for selective temporary attachment to an area of the foot and carrying a marking agent for selectively marking the upper surface of the insole system.

* * * * *